US005309497A

United States Patent [19]

Goetzl et al.

[11] Patent Number: 5,309,497

[45] Date of Patent: May 3, 1994

[54] X-RAY RADIATOR HAVING AN EXTERNALLY ACCESSIBLE FASTENING MEANS

[75] Inventors: Horst Goetzl; Roland Schmidt, both of Erlangen; Hans Stroehlein, Nuremberg; Thomas Weller, Erlangen, all of Fed. Rep. of Germany

[73] Assignee: Siemens Aktiengesellschaft, Munich, Fed. Rep. of Germany

[21] Appl. No.: 18,516

[22] Filed: Feb. 17, 1993

[30] Foreign Application Priority Data

Mar. 6, 1992 [DE] Fed. Rep. of Germany ..... 4207174

[51] Int. Cl.[5] ..... H05G 1/02

[52] U.S. Cl. ..... 378/193; 378/201; 378/204

[58] Field of Search ..... 378/193, 201, 203, 204, 378/205, 119

[56] References Cited

U.S. PATENT DOCUMENTS

| | | | |
|---|---|---|---|
| 2,216,887 | 10/1940 | Machlett . | |
| 2,556,909 | 6/1951 | Feibel et al. | 378/193 |
| 4,247,782 | 1/1981 | Muraki . | |
| 4,433,432 | 2/1984 | Nii et al. | 378/193 |

FOREIGN PATENT DOCUMENTS

| | | | |
|---|---|---|---|
| 144813 | 3/1936 | Austria . | |
| 0092837 | 2/1922 | Czechoslovakia | 378/193 |
| 7425609 | 7/1974 | Fed. Rep. of Germany . | |

*Primary Examiner*—David P. Porta

*Attorney, Agent, or Firm*—Hill, Steadman & Simpson

[57] ABSTRACT

An x-ray radiator has an x-ray tube disposed in a protective housing and a fastening means having a portion attached to the x-ray tube inside the housing, and a portion which extends through the housing to the exterior of the housing. The exterior portion serves as a fastener to attach the x-ray radiator to a mount. The x-ray tube, within the housing, thus becomes directly attached to the exterior mount, which improves the precision with which the specified position of the central ray of the x-ray beam emanating from the x-ray tube can be achieved.

12 Claims, 2 Drawing Sheets

X-RAY RADIATOR HAVING AN EXTERNALLY ACCESSIBLE FASTENING MEANS

BACKGROUND OF THE INVENTION

1. Field of the Invention

The present invention is directed to an x-ray radiator of the type having an x-ray tube contained in a protective housing, and having an external fastening means for fastening the x-ray radiator to a mount.

2. Description of the Prior Art

X-ray radiators are usually constructed with the x-ray tube disposed in the protective housing mounted in a carrier which is, in turn, affixed to one of the interior walls of the housing. For mounting the x-ray radiator in an x-ray diagnostics apparatus, the housing is provided with an external fastener as described, for example, in Austrian Patent 144 813, U.S. Pat. No. 4,247,782, German GM 74 25 609 and U.S. Pat. No. 2,216,887.

A problem in such known structures is that the positional or attitudinal tolerances of the central ray of the x-ray beam which is generated by the x-ray tube within the x-ray radiator are not only dependent on the manufacturing tolerances of the external fastener and of the external mount, but are also dependent on the extent to which the position of the x-ray tube within the protective housing deviates from its specified position. Manufacturing tolerances as well as imprecisions in the assembly of the x-ray radiator can result in deviations of the position of the x-ray tube from its specified position. A significant outlay, with corresponding costs, is thus required in order to assure that the deviations in the position of the central ray from its specified position remain within permissible tolerances.

SUMMARY OF THE INVENTION

It is an object of the present invention to provide an x-ray radiator of the type having an x-ray tube contained in a protective housing wherein an improvement in maintaining the specified position of the central ray of x-ray beam emanating from the x-ray radiator are achieved in a simple manner and with little component outlay.

The above object is achieved in accordance with the principles of the present invention in an x-ray radiator having an x-ray tube and a protective housing in which the x-ray tube is contained, and a fastening means for fastening the x-ray radiator to an external mount, the fastening means having one end attached to the x-ray tube in the housing, and passing through a wall of the housing to the exterior of the housing for direct connection of the x-ray tube to the mount. The precision with which the central ray assumes its specified position relative to the fastening means is therefore dependent only on the precision with which the fastening means is attached to the x-ray tube. The precision with which the specified position of the central ray relative to the mount is achieved, when the x-ray radiator is attached to the mount, is dependent only on the precision with which the fastening means is attached to the x-ray tube, and on the manufacturing precision of the fastening means itself, because the x-ray tube is, in effect, directly attached to the mount by means of the fastening means. In the x-ray radiator constructed in accordance with the principles of the present invention, the position that the x-ray tube assumes within the protective housing is of no consequence with regard to the position of the central ray relative to the fastening means. In comparison to known x-ray radiators, it is much simpler in the x-ray radiator disclosed herein, and involves less outlay, to maintain the specified position of the central ray relative to the fastening means or relative to the mount, because there is no intervening carrier attaching the x-ray tube to the protective housing.

Since the fastening means will usually be formed of a metallic material, in one embodiment of the invention the x-ray tube includes an evacuated housing which is metallic at least in the region at which the fastening means is attached to the x-ray tube. This presents the possibility of joining the fastening means to the evacuated housing of the x-ray tube in a simple manner by soldering or welding.

In further embodiment of the invention, the protective housing is formed by multiple connected parts, with parts of the protective housing being respectively attached to the fastening means. A simple assembly of the x-ray radiator is thereby assured. Moreover, special measures for connecting the protective housing to the x-ray tube can be eliminated, since parts of the housing are attached to the fastening means, which is already present.

In order to provide the fastening means with a high degree of mechanical stability, it is preferable in a further embodiment of the invention to form the fastening means in the shape of a flange. It is also preferable in this embodiment that a part of the protective housing which is attached to the fastening means have a fastening flange, which preferably presses liquid-tight against the fastening means, since the protective housing is usually filled with a liquid coolant.

The x-ray tube is preferably a rotating anode x-ray tube, having an electric motor for driving the rotating anode, with the stator of this electric motor being attached to the fastening means and being disposed outside of the evacuated housing of the x-ray tube. This results in a simple and reliable holding of the stator. The stator can be attached directly to the fastening means, or can be attached thereto by an intervening bracket. In a further embodiment of the invention, the fastening means is provided with centering means for cooperating with corresponding centering means on the mount so as to align the fastening means at a specified position on the mount. The term "centering means" as used herein is used in its broadest sense, for example, as encompassing any type of mating and/or engaging parts such as annular or otherwise shaped projections or openings which interact with corresponding depressions, pins, screws, etc.

DESCRIPTION OF THE PREFERRED EMBODIMENTS

Figure 1:
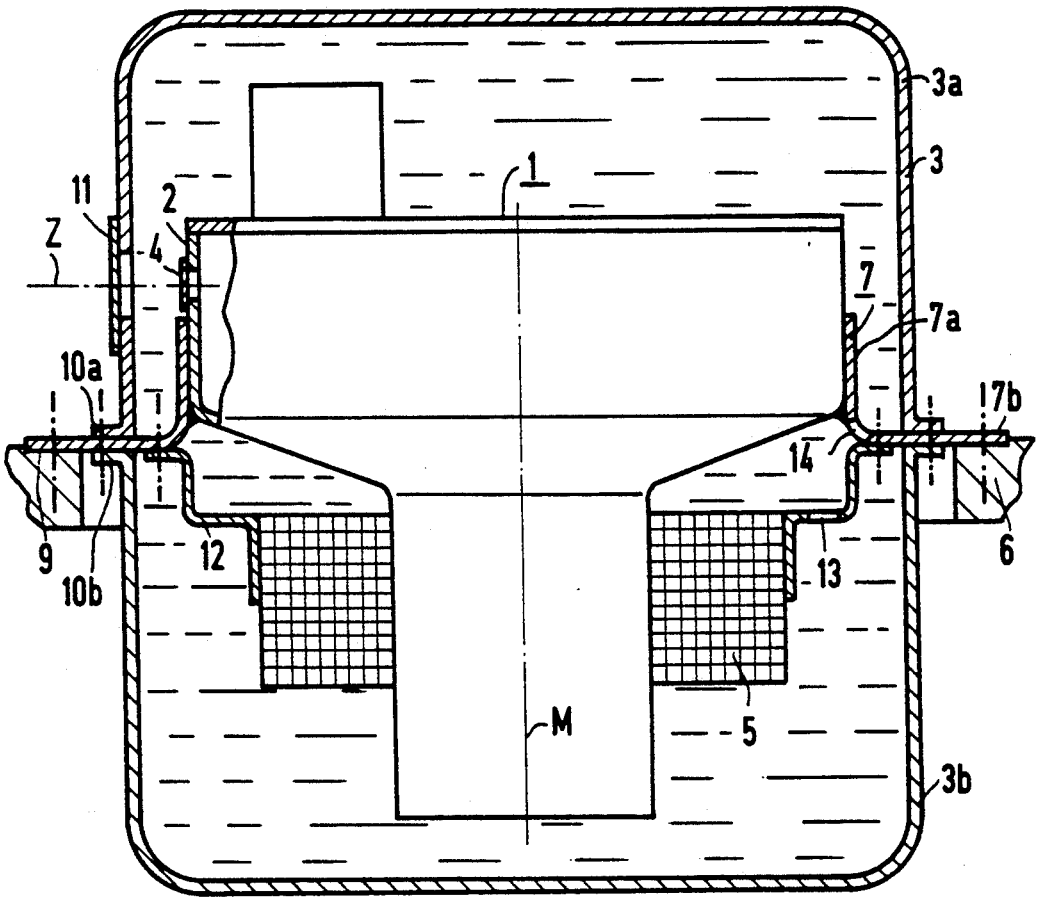
FIG. 1 is a longitudinal sectional view of an x-ray radiator constructed in accordance with the principles of the present invention, with only those components thereof necessary for explaining the invention being shown.

The x-ray radiator constructed in accordance with the principles of the present invention shown in FIG. 1 includes an x-ray tube 1 of known construction. The x-ray tube 1 has an evacuated housing 2 which is metallic, with the exception of the required insulators, and is contained in a protective housing 3 which is filled with an electrically insulating coolant. The x-ray tube 3 is shown broken away in the region of its beam exit window 4, and is a rotating anode x-ray tube having an electric motor for driving the rotating anode in a known manner. The stator 5 of the electric motor is located outside of the evacuated housing 2, and surrounds a region of the x-ray tube 1 having a diminished diameter, in which the rotor (not visible in the drawing) of the electric motor is situated.

The x-ray radiator includes a fastening means, generally referenced 7, for attaching the x-ray radiator to an x-ray radiator mount 6 in an x-ray diagnostics apparatus, which may be a computer tomography apparatus, the remainder of which is not shown in detail in the drawings. The fastening means is in the form of an annular component having an approximately L-shaped cross section, and which is dynamically balanced relative to the central axis M of the x-ray tube 1. The fastening means 7 includes a hollow-cylindrical tube section 7*a* and a circular segment-shaped flange section 7*b*. The middle portion of the evacuated housing 2 of the x-ray tube 1 is received in the tube section 7*a*, this being the portion of the x-ray tube having a larger diameter in which the anode dish (not visible) is located. The glow cathode (also not visible) is disposed in the projection extending from the larger end face of the evacuated housing 2. The tube section 7*a* of the fastening means 7 is connected to the evacuated housing 2 by welding or soldering.

The flange section 7*b* of the fastening means 7 presses against the x-ray radiator mount 6 to which it is secured by screws, with only the center lines of two screws being shown in FIG. 1. The surface of the x-ray radiator mount 6 against which the flange section 7*b* presses has a circular countersink 9, having an outer diameter selected so that the countersink 9 and the outer circumferential edge of the flange section 7*b* interact so as to center the flange section 7*b* relative to the mount 6.

The x-ray tube 1 contained in the x-ray radiator is thus directly attached to the x-ray radiator mount 6 via the fastening means 7, in the sense that an interposition of the housing 3 between the x-ray tube 1 and the x-ray radiator mount 6 is avoided. The flange section 7*b* of the fastening means 7 thus emerges from the interior to the exterior through the protective housing 3. In the embodiment shown in FIG. 1, the protective housing 3 consists of two housing parts 3*a* and 3*b*, which are both shell-like, deep-drawn parts. The housing parts 3*a* and 3*b* have respective fastening flanges 10*a* and 10*b* which press liquid-tight against the flange section 7*b*, to which they are connected by screws, with the center lines of two such screws being shown in FIG. 1. If necessary, a known sealant may be disposed between the fastening flanges 10*a* and 10*b* and the fastening means 7.

The housing part 3*a* has a beam exit window 11 which is disposed in registry with the beam exit window 4 of the x-ray tube 1, so that the x-ray beam emanating from the x-ray tube 1, of which only the central ray Z is shown in FIG. 1, can emerge from the x-ray radiator.

Since the fastening means 7 in the x-ray radiator constructed in accordance with the principles of the present invention is directly attached to the x-ray tube 1, the precision with which the central ray Z assumes its specified position relative to the fastening means 7 is essentially dependent only on the precision with which the fastening means 7 is attached to the x-ray tube 1. The precision with which the central ray Z assumes its specified position with respect to the x-ray radiator mount 6, given an x-ray radiator attached thereto, is dependent only on the manufacturing precision of the fastening means 7 and of the x-ray radiator mount 6, and on the precision with which the fastening means 7 is attached to the x-ray tube 1.

The stator 5 is held by means of a fastening ring 12, which is screwed to the flange section 7*b* of the fastening means 7. The center lines of two screws are shown in FIG. 1. In order to enable circulation of the coolant contained in the protective housing 3, the fastening ring 12 is provided with a plurality of openings 13, one of which is visible in FIG. 1. Openings 14, only one of which is visible in FIG. 1, are provided in the tubular section 7*a* of the fastening means 7 for the same purpose.

Figure 2:
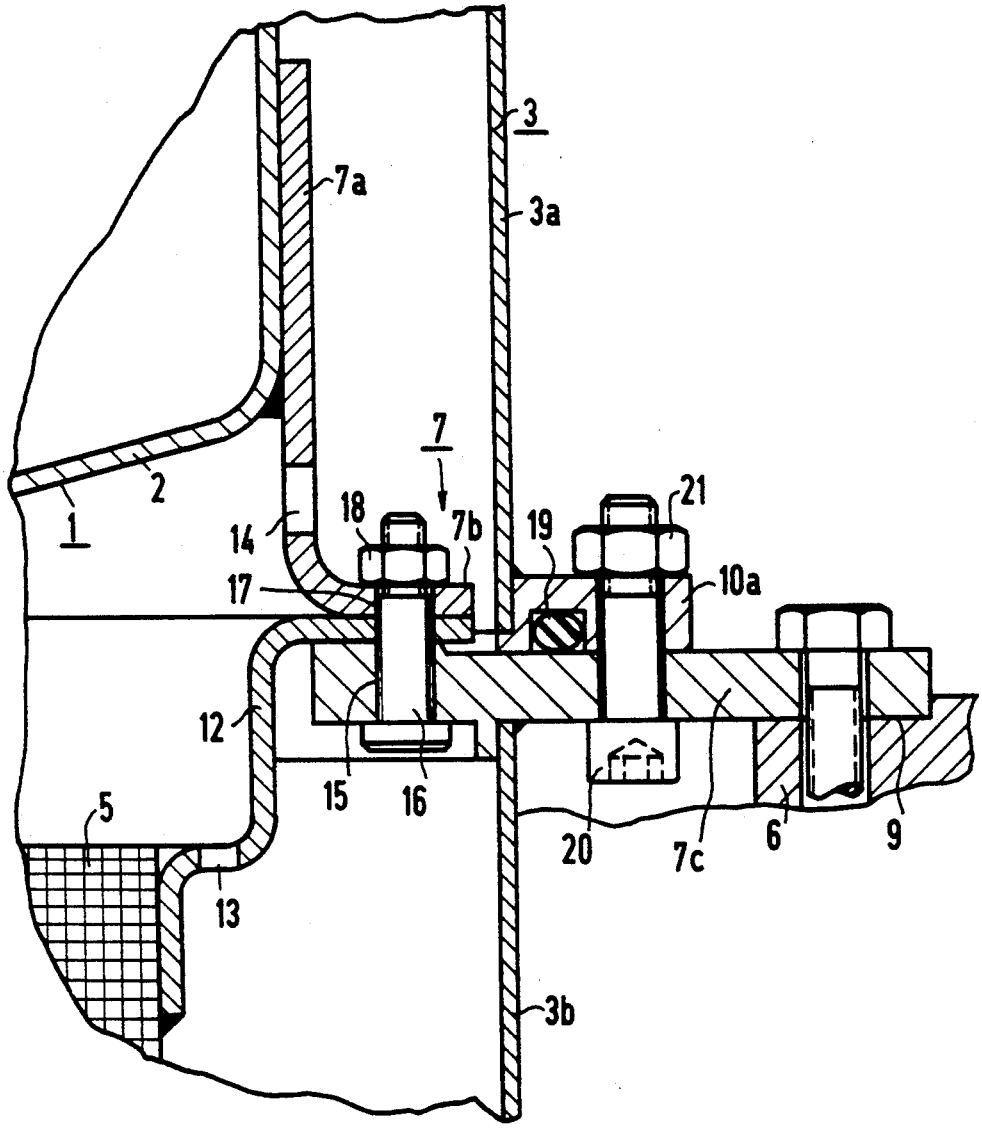
FIG. 2 is an enlarged sectional view of a detail of further embodiment of an x-ray radiator constructed in accordance with the principles of the present invention.

A further embodiment of the invention is shown in FIG. 2, wherein parts coinciding with those described in connection with FIG. 1 have the same reference numerals.

In the embodiment of FIG. 2, the fastening means 7 is formed of two separate parts, and comprises an annular flange 7*c* in addition to the ring having the L-shaped cross section with the tube section 7*a* and the flange section 7*b*. The annular ring flange 7*c* is disposed at the region of the fastening means 7 which emerges toward the exterior through the protective housing 3, and is attached to the x-ray radiator mount 6. The connection of the annular flange 7*c* to the flange section 7*b* is undertaken by shear pins 16 which are pressed into corresponding bores 15, the shear pins 16 having shanks which extend through corresponding bores 17 in the flange section 7*b*. The shanks terminate in threaded ends, onto which nuts 18 are screwed. The fastening ring 12 of the stator 5 is received between the flange section 7*b* and the annular flange 7*c*. One housing part 3*b* of the protective housing 3 is welded liquid-tight to the annular flange 7*c* of the fastening means 7. The fastening flange 10*b*, which was present in the embodiment shown in FIG. 1, can thus be eliminated. The fastening flange 10*a* is joined to the housing part 3*a* by welding. The fastening flange 10*a* is pressed against the annular flange 7*c* with an O-ring seal 19 interposed therebetween. The housing part 3*a* is fastened to the annular flange 7*c* by one or more bolts 20, each provided with a nut 21.

As in the embodiment of FIG. 1, the tube section 7*a* is attached to a metallized region of the evacuated housing 2 of the x-ray tube 1 by welding. As also in the case of the embodiment of FIG. 1, the x-ray radiator mount 6 has a countersink 9. The countersink 9 cooperates with the outer circumferential edge of the annular flange 7*c* of the fastening means 7 for centering.

As is clear from the embodiment of FIG. 2, the fastening means 7 need not necessarily consist of a single part, however, the important common feature of the embodiments of FIGS. 1 and 2 is that a direct connection of the x-ray tube 1 to the x-ray radiator mount 6 is produced via the fastening means 7, such that the position which the x-ray tube 1 assumes within the protective housing 3 does not influence the position of the central ray relative to the fastening means 7, or relative to the x-ray radiator mount 6.

In the above embodiments, the fastening means 7 has been constructed so as to be dynamically balanced, or substantially dynamically balanced. This need not necessarily be the case, and the fastening means could be formed, for example, by a plurality of clips or brackets attached to the x-ray tube 1 which extend to the exterior through the protective housing 3, with which the x-ray radiator is attached to the x-ray radiator mount 6.

Moreover, the embodiments of FIGS. 1 and 2 have been designed to cooperate with existing radiator mounts 6 of known design, since such mounts 6 are already present in existing x-ray diagnostics installations, and thus the x-ray radiator with the fastening means disclosed herein can be used in such existing installations without modifying the installation itself. The x-ray radiator with the fastening means disclosed herein, however, can be effectively utilized with other types of mounts and different mount structures. Moreover, attachment of the fastening means to the x-ray tube 1 need not necessarily ensue by welding; other suitable forms of attachment are possible.

Lastly, the mounting of the stator 5 need not necessarily be undertaken as shown in the exemplary embodiments, although given the structure of the x-ray tube 1 shown in those embodiments, the manner of mounting the stator 5 is particularly advantageous.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator for use with an external mount, said x-ray radiator comprising:

a protective housing;

an x-ray tube disposed inside said protective housing, said x-ray to be generating radiation having a central ray; and fastening means, attached to said x-ray tube and extending through said protective housing to the exterior of said housing, for providing a direct connection of said x-ray tube to said mount for fixing a position of said central ray relative to said mount.

2. An x-ray radiator as claimed in claim 1 wherein said x-ray tube includes an evacuated housing, said evacuated housing being metallic at least at a region at which said fastening means is attached to said the x-ray tube.

3. An x-ray radiator as claimed in claim 1 wherein said protective housing consists of at least two parts with at least one of said at least two parts being attached to said fastening means.

4. An x-ray radiator as claimed in claim 1 wherein said fastening means is in the shape of a flange.

5. An x-ray radiator as claimed in claim 1 wherein said protective housing consists of at least two parts and wherein said fastening means is in the shape of a flange having a leg extending between said two parts, at least one of said at least two parts having a fastening flange disposed against said leg of said flange forming said fastening means.

6. An x-ray radiator as claimed in claim 5 further comprising means for pressing said fastening flange liquid-tight against said leg of said flange forming said fastening means.

7. An x-ray radiator as claimed in claim 1 wherein said x-ray tube is a rotating anode x-ray tube having a rotating anode disposed in an evacuated housing and an electric motor for driving said rotating anode, said electric motor having a stator disposed outside of said evacuated housing, and wherein said x-ray radiator further comprises bracket means for attaching said stator to said fastening means.

8. An x-ray radiator as claimed in claim 1 wherein said fastening means includes centering means for cooperating with said mount for centering said fastening means relative to said mount.

9. An x-ray radiator as claimed in claim 1 wherein said fastening means comprises means for fastening said x-ray radiator to said x-ray radiator mount in an x-ray diagnostics apparatus.

10. An x-ray radiator for use with an external mount, said x-ray radiator comprising:

a protective housing;

an x-ray tube disposed inside said protective housing; and fastening means for fastening said x-ray radiator to said mount formed by a one-piece L-shaped flange having a first leg attached to said x-ray tube and a second leg emerging through said protective housing to the exterior thereof and being attachable to said mount.

11. An x-ray radiator for use with an external mount, said x-ray radiator comprising:

a protective housing;

an x-ray tube disposed inside said protective housing; and fastening means for fastening said x-ray radiator to said mount including first and second elements, said first element consisting of an L-shaped flange having a first leg attached to said x-ray tube and a second leg terminating inside said protective housing, said second element consisting of a bracket disposed adjacent said second leg of said L-shaped flange and extending through said protective housing to an exterior of said protective housing and being attachable to said mount, and said fastening means further including means for rigidly holding said second leg of said L-shaped flange to said bracket.

12. An x-ray radiator as claimed in claim 11 further comprising an attachment flange connected to and extending from the exterior of said protective housing adjacent said bracket, and means for rigidly connecting said attachment flange to said bracket.

* * * * *